United States Patent [19]

Orjala

[11] Patent Number: 4,515,088

[45] Date of Patent: May 7, 1985

[54] BURNER FOR PELLETS

[75] Inventor: Markku Orjala, Jyväskylä, Finland

[73] Assignee: Valtion Teknillinen Tutkimuskeskus, Finland

[21] Appl. No.: 515,048

[22] PCT Filed: Nov. 3, 1982

[86] PCT No.: PCT/FI82/00055

§ 371 Date: Jun. 27, 1983

§ 102(e) Date: Jun. 27, 1983

[87] PCT Pub. No.: WO83/01671

PCT Pub. Date: May 11, 1983

[30] Foreign Application Priority Data

Nov. 5, 1981 [FI] Finland ..... 813487

[51] Int. Cl.[3] ..... F23K 3/14

[52] U.S. Cl. ..... 110/110; 110/102

[58] Field of Search ..... 110/110, 102, 263, 264, 110/265, 266

[56] References Cited

U.S. PATENT DOCUMENTS

| | | | |
|---|---|---|---|
| 1,831,912 | 11/1931 | Hoffman . | |
| 2,584,235 | 2/1952 | Skelly | 110/110 X |
| 2,932,713 | 4/1960 | Powers | 110/110 X |
| 3,472,185 | 10/1969 | Burden, Jr. | 110/110 X |
| 3,513,778 | 5/1970 | Ostrin | 110/8 |
| 4,096,808 | 6/1978 | Trickel | 110/244 |

FOREIGN PATENT DOCUMENTS

| | | |
|---|---|---|
| 431209 | 7/1926 | Fed. Rep. of Germany . |
| 1033663 | 4/1953 | France . |
| 1059233 | 3/1954 | France . |
| 66631 | 8/1943 | Norway . |
| 11324 | 5/1899 | Sweden . |
| 109115 | 11/1943 | Sweden . |

*Primary Examiner*—Edward G. Favors

*Attorney, Agent, or Firm*—Andrus, Sceales, Starke & Sawall

[57] ABSTRACT

In the combustion of granular fuels in current use the ash causes problems in fusing, in connection with combustion and ash extraction and additionally in the form of fuel lost when it becomes intermingled with the ash. In the burner according to the invention the fuel is continuously fed (1) into the combustion space (9). The combustion air is fed (4) to the space (10) between the tubular parts (2,3) and from there on through the lower holes (11) in the primary air flange (7) to the perforations (12) in the grate (5) below the combustion fuel layer. The secondary air is led through the flange (7) upper part by way of the turboelements (14) and air slits (13), as a horizontally swirling air flow through the combustion chamber (9) to the furnace, where gases are burned while flowing in at a horizontal level. The flame flowing on this horizontal axis combusts any burning fuel which may have fallen to the bottom of the furnace. The ashes are extracted through the open mouth of the combustion chamber (9) to the bottom of the furnace, partly fused and partly dry. Alternatively ashes fall to the feed base located in the combustion chamber (9) from which it is extracted from the boiler.

3 Claims, 3 Drawing Figures

BURNER FOR PELLETS

The object of the invention is a burner used, for combusting granular fuel, especially combustion of pelletised fuel. The burner is formed of two tubular parts, one partly within the other and flanged together and it can be equipped with special ash extraction equipment.

BACKGROUND OF THE INVENTION

In central heating boilers built for solid fuel combustion in which the fuel burns on a level grate, either of metal rods or on a continuously bricked hearth, the behaviour of ash causes problems when using granular fuel manufactured of artificially dried material rich in ash content. The ashes soften and partly fuse and also while cooling form solid clinker, preventing the entry of the combustion air into the fuel material level and gradually choke combustion. The maintenance interval, based on results from combustion experiments with the smaller type of boiler in use today, has been experimentally determined as only 3–4 hours when tests were carried out when peat pellets, and is using industrially processed fuel no gain will be achieved in comparision with the traditional wood and peat fuels.

Fuel feeding and fuel combustion equipments to be installed as additional equipment to the boiler and intended for use with granular fuels are stokers, meant for combustion of wood chips, and various kinds for crucible and crucible burners, or equipment for other granular fuels modified from these, such as equipment for peat pellets. Stokers and crucible burners are installed in the furnace so that the gas flame is directed vertically upwards so that the combustion equipment takes up part of the furnace space.

It is known that fuel feeding equipment to the grate is also in use in which additional air is led by the feeding equipment to the gas combustion space above the grate. This kind of feeding equipment is illustrated for example in SE Patent Publication No. 109 115. The feeding equipment according to the patent publication cannot be used as an independent burner, as the combustion of the fuel occurs on a separate grate.

In general the ashes are meant to be extracted from the stoker fuel combustion space by the screw conveyor and under the influence of the combustion air. Whilst fusing and further cooling down the ashes form solid particles which adhere to the walls of the combustion chamber. While the fuel feed continues and the ashes lessen the stoker combustion space and prevent the flow of combustion air, the screw conveyor thrusts the fuel over the stoker edges to the bottom of the boiler.

The feed of combustion air into the combustion crucible occurs through the grate at right angles to the fuel layer. It is intended that ash is removed together with the gas flow as dust. The smallest particles of the fuel are taken with the gas flow before they reach the grate and float down to the bottom of the boiler as they impinge on the boiler walls. At the bottom of the boiler the temperature is so low, that the fuel that has scattered there does not burn and thus causes significant losses. In the combustion tests on peat pellets it was verified that the peat loss caused by the fuel fallen into the ashes in a typical crucible burner was at least 10% as compared with expected thermal value. When burning peat pellets the ashes, as they fall down onto the crucible grate and cool down further, form solid clinker, which gradually clogs the whole burner and thus prevent combustion.

SUMMARY OF THE INVENTION

The purpose of this invention is to achieve an improvement in solid fuel burners and to achieve a burner which will avoid detrimental aspects of ash extraction and combustion and also diminish heat losses caused by fuel falling into the ashes.

The advantage of this invention is the lengthening of the maintenance interval as compared with contemporary technological practice. The interval is independent of the burner action and is determined by the size of the ash space, the fuel feed silo size and the fuel characteristics.

An additional advantage is its suitability for inclusion in an automatically operating heating system, because of its steplessly variable power regulation capability.

The objectives of the invention are achieved by equipment to which the requirements set out in the patent claims is characteristic.

DESCRIPTION OF THE DRAWINGS

In the following the invention is described by referring to the accompanying drawing, in which.

DESCRIPTION OF THE ILLUSTRATED EMBODIMENT

Figure 1:
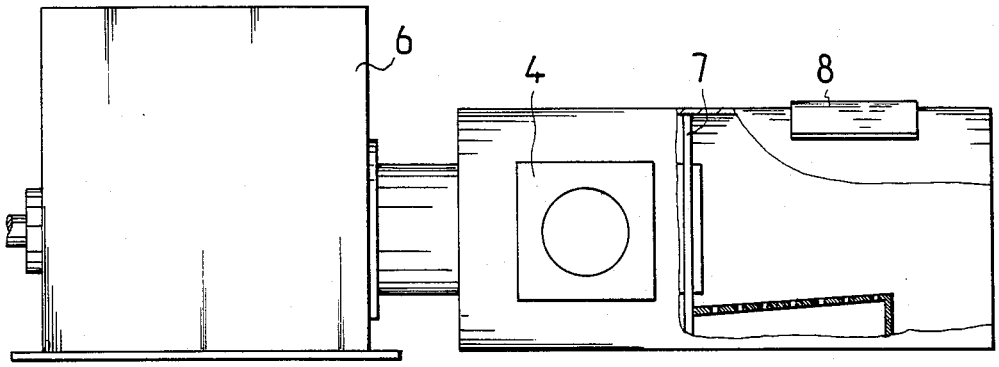
FIG. 1 shows one of the modes of application of the invention, in a partly cut away view
Figure 2:
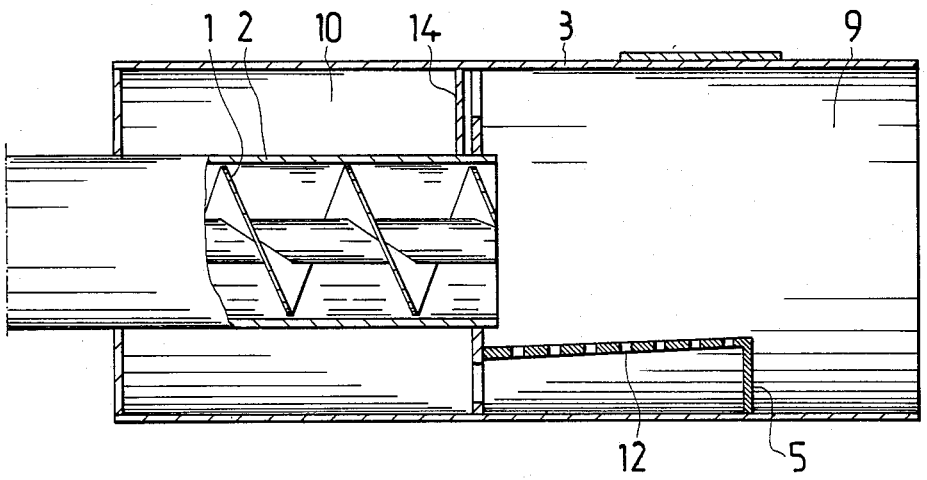
FIG. 2 shows one of the modes of application, as a cross-section
Figure 3:
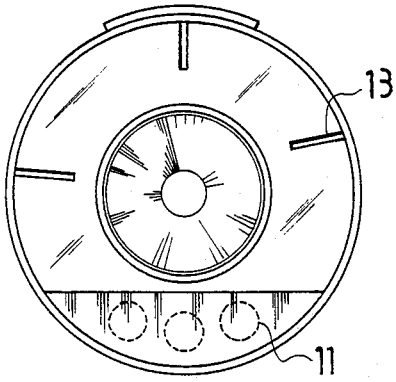
FIG. 3 shows the end projection of FIG. 2.

The burner is constructed of two tubular parts, one within the other 2,3, the fuel being fed through the inner part 2 by means of a screw conveyor 1, or by some other recognised method, into the combustion space 9 and the outer tubular section 3 acts as an air-feeding pipe 10 and combustion space 9. The tubular parts 2,3, are interconnected by means of flange 7 between the combustion space 9 and the air-feeding space 10. In flange 7 are air-feeding apertures consisting of the primary air aperture 11 in the lower part of flange 7, the turboelements 14 in the upper part of flange 7 and the secondary air slits 13.

The fuel is fed from the fuel silo 6 or the slowly revolving screw 1, or by other recognised continuously operating methods, to the combustion space 9. The burner is lit, for example, through ignition hatch 8. The combustion air is fed in through 4 into space 10 between tubular parts 2 and 3 and from there on through holes 11 in the lower part of the primary air flange 7 to underneath the grate, at 5. From there it is led through the apertures in the grate 5 to the underneath of the fuel layer fed to the grate 5.

The secondary air is led through the turboelements and air-slits 13 as a rotating flow in the horizontal axis via combustion chamber into the boiler furnace where the gases are combusted flowing on a horizontal level. The flame flow being in the horizontal axis results in combustion of burning fuel which may have fallen to the bottom of the furnace.

The ashes are extracted from the mouth of the combustion chamber 9 partly fused and partly dry in the example proposed here, to the bottom of the furnace. The burner can also be furnished with a separate screw ash-conveyor which is located at the bottom part of the fuel feeding screw so that the ashes fall to the open feed base which is a continuation of the casing of the screw of combustion chamber 9 and from there the screw conveys the ashes to the external ash-collection space.

In the combustion tests carried out on the prototype burner in which the inner diameter of the inner tube was 65 mm and the inner diameter of the outer was 138 mm the combustion was complete and the combustion efficiency ratio 80–85%. The boiler was installed in a twin-furnace boiler. The combustion power was about 20 kW and the boiler power achieved was 14–15 kW. The flue gas temperature was about 300° C. The direct efficiency ratio was about 70%.

The burner is especially suitable for combustion of pelletised peat, but its operational principle can also be applied to other granular fuels.

However this invention is not limited to the aforementioned examples and can be varied within the limits of the patent claim.

I claim:

1. A burner for the combustion of granular fuels, comprising an inner tube, an outer tube spaced outwardly of the inner tube with the space between said tubes defining an air supply chamber, the outer end of the outer tube projecting beyond the inner end of the inner tube and the projecting end of the outer tube defining a combustion chamber, a flange connecting the outer end of the inner tube to said outer tube and separating said air supply chamber from said combustion chamber, a grate disposed within the lower end of the combustion chamber, the lower end of said flange having at least one hole providing communication between the said supply chamber and said grate, the upper portion of said grate having a plurality of openings whereby air flows upwardly from the grate into the combustion chamber, and air distribution means in the upper end of said flange for delivering air from said air supply chamber to said combustion chamber in a swirling pattern.

2. The burner of claim 1, wherein said air distribution means comprises a plurality of circumferentially spaced radially extending slits.

3. The burner of claim 2, and including turboelements disposed in said air supply chamber upstream of said slits.

* * * * *